United States Patent [19]

Inazaki et al.

[11] 4,382,516

[45] May 10, 1983

[54] METHOD OF AND APPARATUS FOR CLASSIFYING STEEL PRODUCTS

[75] Inventors: Koji Inazaki; Takayuki Ueda; Toshihiro Oka; Rippo Kawai, all of Muroran, Japan

[73] Assignee: Nippon Steel Corporation, Tokyo, Japan

[21] Appl. No.: 264,254

[22] Filed: May 18, 1981

[51] Int. Cl.[3] ..... B07C 5/14

[52] U.S. Cl. ..... 209/517; 209/706; 209/933; 209/942; 209/564; 209/702; 414/787; 198/347; 198/413

[58] Field of Search ..... 209/706, 925, 933, 942, 209/606, 564, 565, 566, 518, 519, 520, 702, 517; 198/347, 413; 414/331

[56] References Cited

U.S. PATENT DOCUMENTS

| | | | |
|---|---|---|---|
| 1,565,984 | 12/1925 | Brockenbrough | 414/331 |
| 3,456,773 | 7/1969 | Titmas, Jr. | 209/925 |
| 3,587,852 | 6/1971 | Kamm et al. | 209/655 |

*Primary Examiner*—Allen N. Knowles
*Attorney, Agent, or Firm*—Pollock, Vande Sande & Priddy

[57] ABSTRACT

A sorting method and apparatus for sorting steel products such as bars, rods, shapes and tubular products which are delivered in a random manner, according to the ordered lengths, sizes and so forth. The steel products are made to stay on a sorting apparatus temporarily. Then, pieces of products of the same class are successively selected and forwarded to a bundling bed from the sorting apparatus, while the latter receives a new piece of steel products. This operation is repeated for successive classes to sort the steel products into a plurality of classes having different ordered lengths, sizes or other sorting condition. The sorting apparatus has a vertically movable sorting roller table and a sorting truck arranged in a side-by-side relation to the sorting roller table and movable in the direction normal to the direction of movement of the steel products.

9 Claims, 12 Drawing Figures

METHOD OF AND APPARATUS FOR CLASSIFYING STEEL PRODUCTS

BACKGROUND OF THE INVENTION

Steel products such as bars, rods, shapes and tubes of steel after having been formed by hot rolling are sorted according to an ordered length, size, specification, standards, presence of flaw, defects and other surface conditions, and are bundled into predetermined number of units and a predetermined shape before shipping.

The present invention relates to a method of and an apparatus for sorting, thereby making it possible to sort these steel products flowing along a sorting line, efficiently and correctly with quite a simple equipment.

It is a current tendency that the users or customers designate the lengths of products, with varying changes of length in the order of hundreds of millimeters so that the number of kinds of the products is increasing. For achieving a higher yield rate, therefore, it is desired to increase the number of the sorting beds. However, as will be explained later in more detail with reference to the drawings, the conventional sorting method requires a drastic increase of the installation cost, as well as lowered rate of operation of each sorting bed, when the number of the sorting beds is increased. The increased number of sorting beds also necessitates greater mill floor space and widened conditions of operation, and makes unmanned operation difficult. Furthermore, since the steel products are conveyed a long distance in groups, various troubles are liable to occur such as misalignment of the ends of products, overlapping and so forth, resulting in a lowered treating efficiency.

SUMMARY OF THE INVENTION

Accordingly, an object of the present invention is to obviate the above described problems of the prior art by providing an improved sorting method and apparatus.

To this end, according to an aspect of the invention, there is provided a sorting method for steel products, comprising the steps of temporarily accumulating steel products of different length delivered by an inlet table in a random manner on a sorting apparatus having variable mounting position with respect to transfer tables each consisting of a roller table and a sorting truck; selecting desired one from the steel products staying on the sorting apparatus; and forwarding the selected steel product to an outlet table, while taking up a subsequent steel product from the inlet table; and repeating the above-mentioned steps one after another, whereby the steel products of various classes randomly transferred into the sorting apparatus are successively sorted into desired kinds in accordance with desired length, size, surface defects such as flaws, scratches and the like.

According to another aspect of the invention, there is provided an apparatus for sorting steel products, characterized by comprising a vertically movable receiving roller table and a dispatching roller table; a sorting roller table movable in both upward and downward directions and a sorting truck movable in the direction normal to the direction of movement of said steel product.

The above and other objects, features and advantages of the invention will become clear from the following description of the preferred embodiments taken in conjunction with the accompanying drawings.

DESCRIPTION OF THE PREFERRED EMBODIMENTS

Before turning to the detailed description of the preferred embodiments, an explanation will be made as to the conventional sorting system with specific reference to FIG. 1, in order to facilitate understanding of the drawbacks of the prior art and, hence, the advantages of the invention over the prior art.

Figure 1:
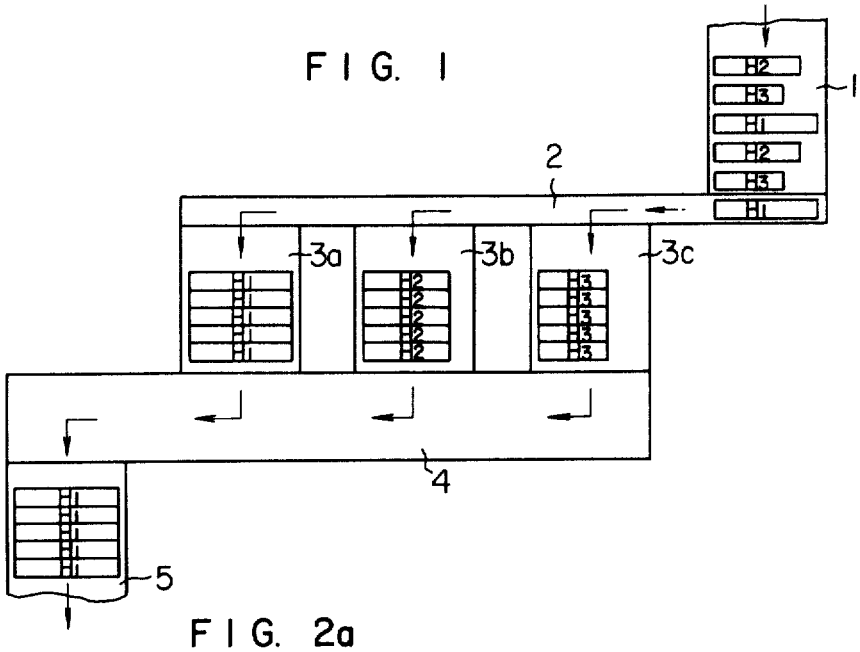
FIG. 1 is a plan view of a conventional system for sorting steel products.

Referring to FIG. 1, a typical conventional sorting apparatus has a plurality of sorting beds 3*a*, 3*b*, 3*c* each of which having a traversing mechanism such as a chain transfer means. Usually, 3 to 5 sorting beds are used.

The steel products $H_1$, $H_2$ and $H_3$ which have been cut into various ordered lengths are delivered to an inspection bed 1 where the size and shape are inspected. Thereafter, the products $H_1$, $H_2$ and $H_3$ are taken into respective sorting beds 3*a*, 3*b*, 3*c* according to the ordered lengths by means of the inlet table. These steel products are made to stay on these sorting beds and dispatched out in bundling units each including, for example, 5 product lengths by a delivery table 4 having a width greater than the inlet table 2, to a bundling bed 5 where the products are bundled.

As mentioned before, it is a current tendency that the users or customers designate the lengths of products with varying changes of length in the order of hundreds of millimeters so that the number of classes per length of the product is being increased. For achieving a higher yield rate, therefore, it is required to increase the number of sorting beds. However, the conventional sorting method requires a drastic increase of the installation cost, and impractically lowers the rate of operation of each sorting bed, when the number of the sorting beds is increased.

The increased number of sorting beds also necessitates greater mill floor space and widened conditions of operation, and makes unmanned operation difficult. Furthermore, since the steel products are conveyed a long distance in units each containing several products, various troubles occurs such as misalignment of the ends of products, overlapping and so forth, resulting in a lowered treating efficiency.

These problems are overcome by the sorting method and apparatus of the invention, as will be understood from the following description of the embodiments of the present invention.

Referring to FIGS. 2*a* to 2*f* and 3, steel products of various lengths are brought into the sorting system along a first path through inlet table 2. These steel products are temporarily held for accumulation on a sorting apparatus which consists of a vertically movable roller table 6, a transversely movable sorting truck 7 having variable mounting position relatively to a transfer table and so forth. A steel product of a predetermined length is selected out of the steel products staying on the sorting truck and is delivered along a second path to an outlet table 4. This operation is repeated one after another to sort the steel products into classes according to the size, specifications or standards, presence of surface defects such as flaws and so forth.

Briefly, the sorting system of the invention for carrying out the above-described method includes the inlet table 2, outlet table 4 and a sorting apparatus disposed between these tables. The sorting apparatus has a vertically movable sorting roller table 6 and a transversely movable sorting truck 7 which is movable at a right angle to the direction of movement of the steel products and disposed in a side-by-side relation to the sorting roller table 6.

Preferred embodiments of the method and apparatus of the invention will be described in more detail hereinunder with specific reference to FIGS. 3, 4 and 5.

Figure 3:
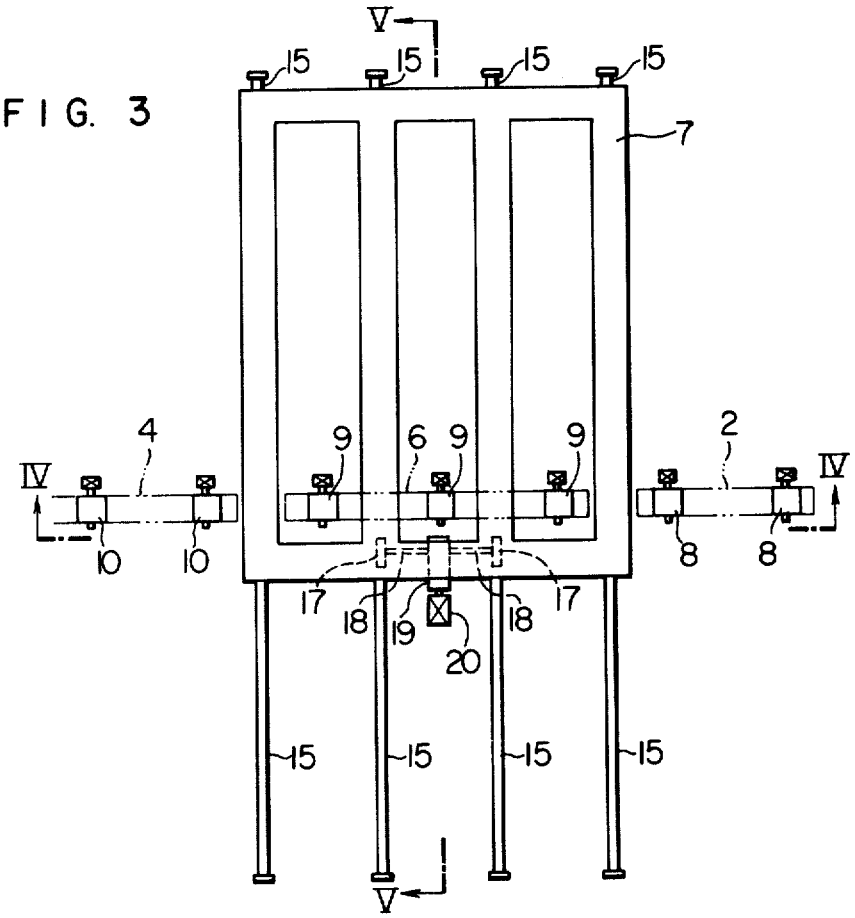
FIG. 3 is a plan view of the whole part of a sorting apparatus in accordance with an embodiment of the invention.

Referring to FIG. 3, rollers 8 are the rollers of the roller table 2, while the rollers 10 are the rollers of the roller table 4, disposed in the vicinity of the sorting truck 7. As shown, the flow path of roller table 2 is aligned with that of roller table 4.

Figure 4:
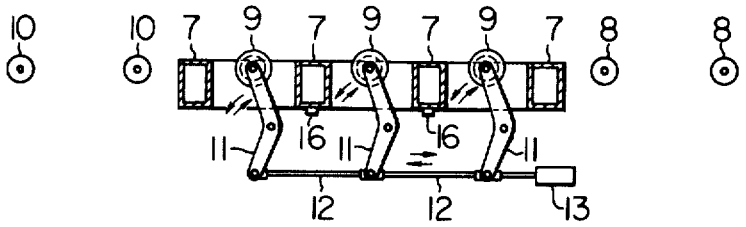
FIG. 4 is a sectional view taken along the line IV—IV of FIG. 3.

As will be seen from FIG. 4, vertically movable roller table 6 has flanged rollers 9 of a width somewhat larger than the width of the steel products, a link mechanism 11, rod 12, and a cylinder 13. The arrangement is such that the rollers are moved up and down as the cylinder 13 is actuated, in order to avoid the interfere with the steel products on the sorting truck 7. Namely, the rollers 9 are lowered when the sorting truck 7 is traversed. The rollers 9 can take the highest level flush with the rollers 8 and 10, and the lowest level somewhat lower than the upper surface of the sorting truck 7.

Figure 5:
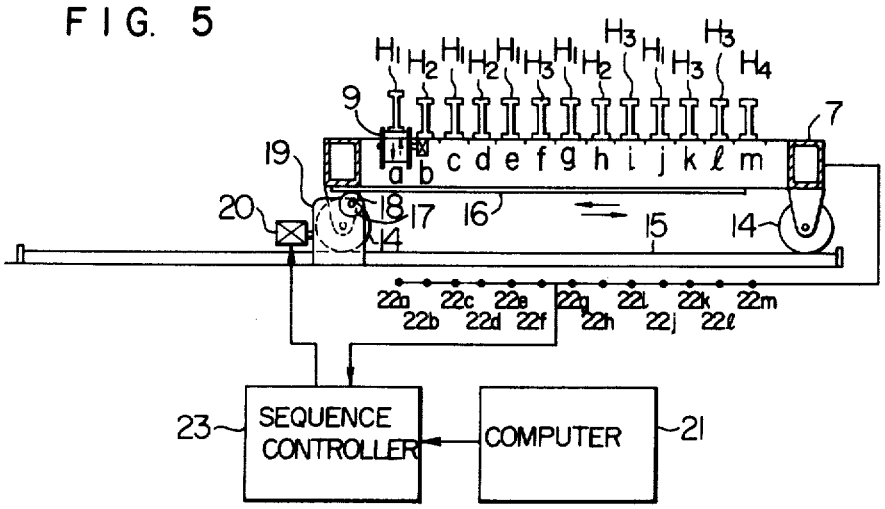
FIG. 5 is a sectional view taken along the line V—V of FIG. 3.

As will be understood from FIG. 5, the sorting truck 7 is provided with several wheels 14. The upper surface of the sorting truck 7 is positioned substantially at the mid height between the highest and lowest positions of the rollers 9. The driving system for the sorting truck 7 includes a rack 16, pinion 17, pinion shaft 18, reducer 19 and a driving motor 20. The sorting truck 7 is moved on the rail 15 through the wheels 14 as the motor 20 is energized.

The sorting truck 7 is provided with a multiplicity of limit switches 22*a*, 22*b*, 22*c* . . . 22*m*. The number of the limit switches corresponds to the maximum number of steel products which can be simultaneously accumulated on the sorting truck 7. The movement of the sorting truck 7 is controlled by a computer 21 and sequence controller 23, in accordance with the truck position information and tracking information which are derived from the input signal of the limit switches. The limit switches may be mounted on the rail, instead of being mounted on the truck 7.

Hereinafter, a preferred embodiment of the sorting method of the invention will be explained in detail.

FIGS. 2*a* to 2*f* are partial plan views of a rolled product arranging line, for explaining the sorting method of the invention.

For an easier understanding, explanation here will be made on the sorting according to the length of the steel products although the method of the present invention is applicable to the sorting in accordance with other factors such as size, or specifications standards, presence of surface defects such as flaws and so forth.

The steel products of various ordered lengths conveyed in a random manner are at first delivered to an inspection bed 1 for inspecting the size, shape and so forth, and are transferred through an inlet table 2 and vertically movable roller table 6 onto a sorting truck 7 so as to be temporarily accumulated in the latter.

Figure 2A:
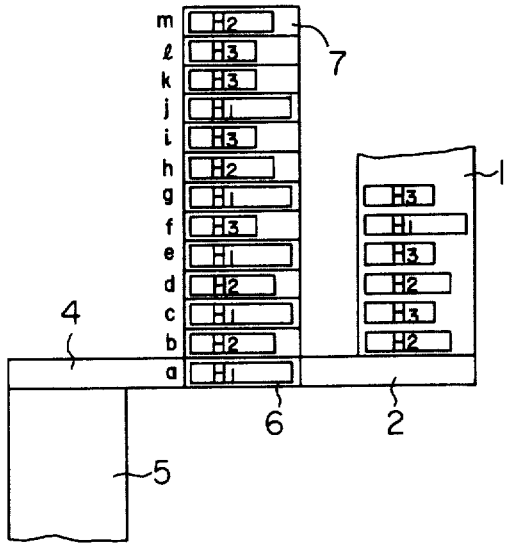
FIGS. 2*a* to 2*f* are plan views illustrating the sequence of sorting method in accordance with the invention.

After a predetermined number of steel products are accumulated or stored on the truck 7, the steel products of the same length are sent as a unit to a bundling bed 5 where the products are stacked in a predetermined form of bundling and then bundled. FIG. 2*a* shows the state in which the sorting truck 7 accumulates the steel products to its full capacity, by the combined operation of the inlet table 2 and vertically movable roller table 6, and the traversing of the sorting truck 7.

More specifically, at a position (a) on the sorting truck 7, a steel product $H_1$ is placed. Similarly, steel products $H_2$, $H_1$, $H_3$ and $H_2$ are placed at the positions (b), (c), (l) and (m), respectively, on the truck 7. Meanwhile, the inspection bed 1 has succeeding products of various lengths.

Figure 2B:
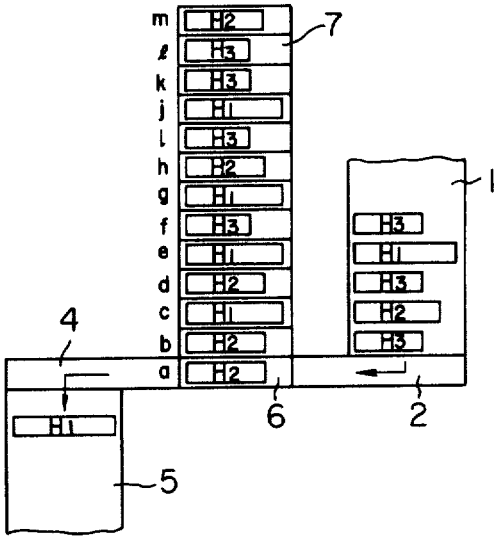
Figure 2C:
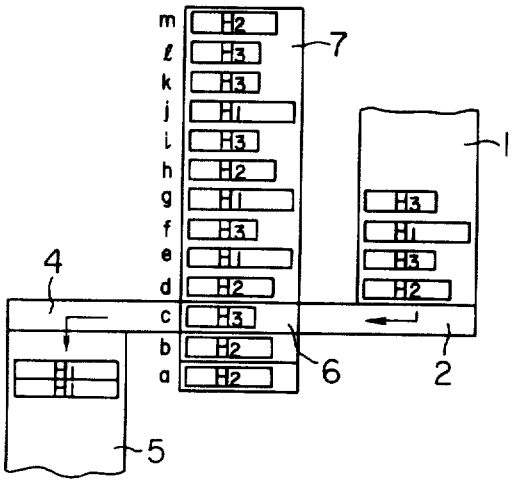

Referring to FIG. 2*b*, five steel products of a length $H_1$ for just making one bundle have been placed on the sorting truck 7. Therefore, the steel product $H_1$ at position (a) is transferred to the bundling bed 5 through the sorting table 6 and the outlet table 4, in order to form the bundle of the steel products $H_1$. Meanwhile, the next steel product, which is the product $H_2$, is fed to the vacant position, position (a) of the sorting truck through the inlet table 2 and sorting table 6. The second one of the steel product $H_1$ is at the position (c). Therefore, as shown in FIG. 2(*c*), the sorting truck 7 traverses to the position where the position (c) on the truck 7 coincides with the sorting roller table 6, downwardly as viewed in the drawing, and the second one of the steel products $H_1$ is delivered to the bundling bed 5 through the sorting roller table 6 and the outlet table 4. Simultaneously, the next steel product, which in this case is the product $H_3$, is fed to the new vacant space, i.e. to the position (c) on the sorting truck 7, through the inlet table 2 and the sorting roller table 6.

Figure 2D:
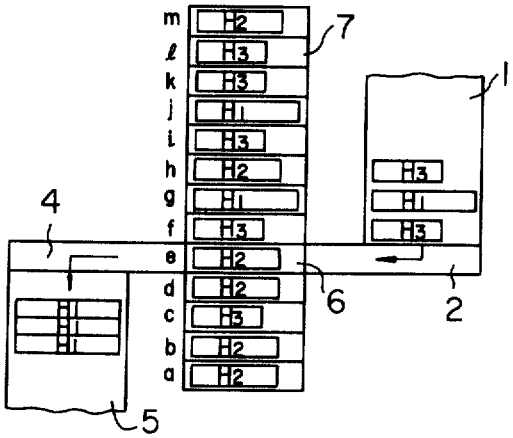

In the state shown in FIG. 2*d*, the sorting truck 7 has traversed to the position where the position (e) coincides with the sorting table 6, and the third one of the steel product $H_1$ has been forwarded to the bundling bed 5, while the new vacant space, i.e. the position (e) has been filled with the next steel product which is in this case the product $H_3$.

Figure 2E:
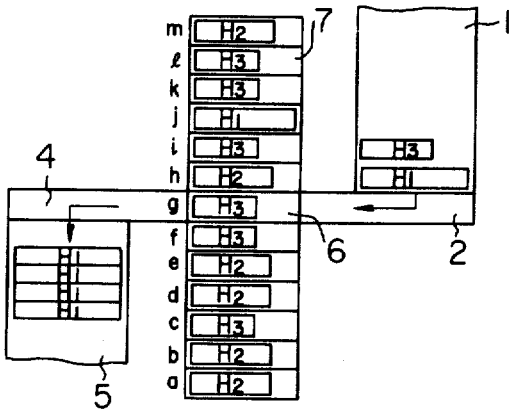

Similarly, in the state shown in FIG. 2*e*, the steel product $H_1$ has been forwarded from the position (g) on the sorting truck 7, and this position is newly loaded with the next product which is in this case the product $H_3$.

Figure 2F:
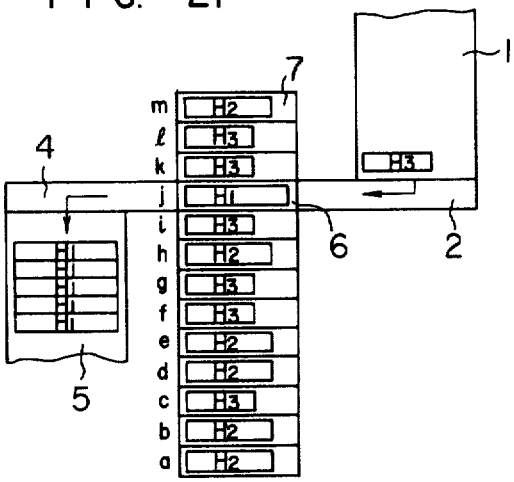

Finally, as shown in FIG. 2*f*, the sorting truck 7 traverses to the position where the position (j) coincides with the sorting truck 7 to discharge the final one of the steel products $H_1$ to the bundling bed 5 while taking the next steel product $H_1$ to the position (j).

It will be seen that, at this time, five steel products $H_1$ are stored on the bundling bed 5. Thus, the sorting apparatus is ready for making one bundle of the steel products $H_1$.

In the state shown in FIG. 2*f*, five pieces of steel products $H_2$ have and five pieces of steel products $H_3$ are already prepared on the sorting truck 7. Therefore, the sorting truck 7 is traversed successively to the positions (m), (h), (e), (d), (b), (c), (f), (g), (i) and (k) into alignment with the sorting table 6 to successively receive, sort and bundle the steel products $H_2$ and $H_3$.

It is thus possible, in this manner, to sort and bundle the steel products of various ordered lengths delivered in a random manner, into several groups each consisting of the same ordered length.

Hereinafter, an explanation will be made how the control of the sorting operation is made in the sorting system of the invention, by way of example.

In this example, a computer is used as a supervisory control means which determines the timing of receiving the product from the sorting table and delivery of the steel product to the sorting table, position to which the sorting truck is to be moved and so forth. Also, a sequence controller is used as controlling means which controls the actual operation of the mechanical equipments in accordance with the signals derived from the computer.

Figure 6:
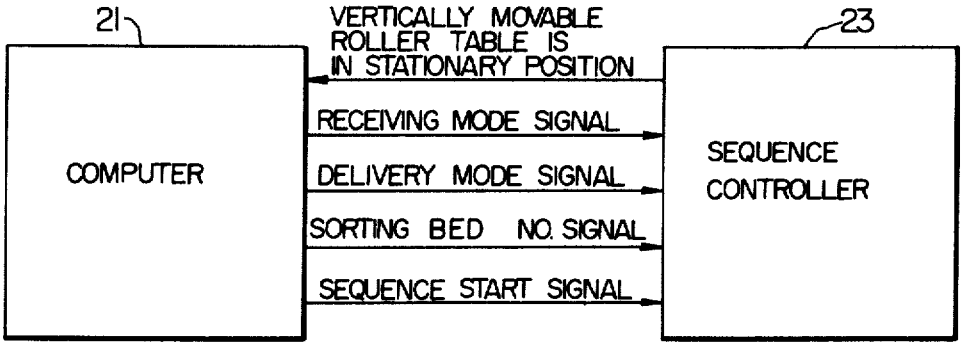
FIG. 6 is an illustration of a control signal.
Figure 7:
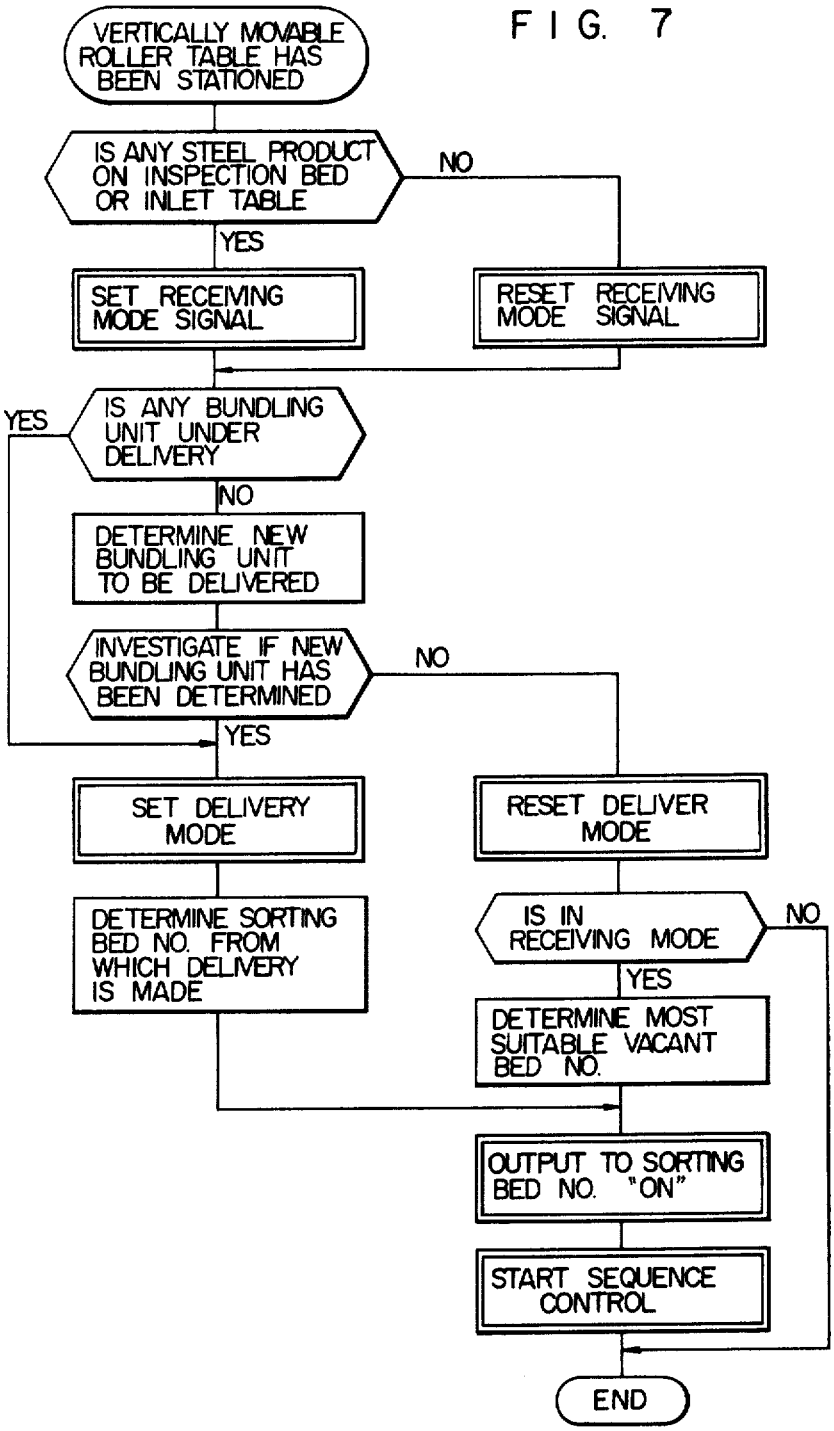
FIG. 7 illustrates a logic set in a computer.

FIG. 6 illustrates the control signals which are exchanged between the computer 21 and the sequence controller 23, while FIG. 7 shows the logic set up in the computer 21.

In this example, one cyclic sequence of operation includes the successive steps of lowering of the vertically movable roller table 6 from the stationary position, traversing of the sorting truck 7 to a predetermined position, lifting of the vertically movable roller table 6, discharging and feeding of the steel products, and stationing of the roller table 6 at the raised position.

To this end, as will be seen from FIG. 6, the computer 21 starts the program upon receipt of a signal representing that the roller table 6 has been stationed. This signal is given by the sequence controller 23. A receiving mode signal delivered by the computer 21 to the sequence controller 23 is the signal for setting the receipt of the next steel product by the sorting truck 7, while the delivery mode signal is the signal for setting the delivery of the steel products from the sorting truck 7. When any steel product is to be delivered from the truck 7, the sorting bed No. signal, i.e. a signal representing the position on the truck 7, is delivered simultaneously with the delivery mode signal. A sequence start signal for starting the automatic operation of the sequence controller 23 is delivered after the delivery of all setting signals.

An actual example of control will be explained hereinunder with reference to FIG. 7 showing the logic set up in the computer 21.

As stated before, the computer 21 is started by the sequence controller 23 when the vertically movable sorting table 6 has been stationed after the completion of the preceding cycle of sequential operation. The computer 21 information of steel products on all lines, and knows the kinds and locations of all steel products. First of all, a check is made by the computer in accordance with the stored information as to whether any steel product is on the inspection bed 1 or the inlet table 2. If the rolling is ceased or if the supply of the material is suspended for a long time, no steel product is placed on the inspection bed 1 nor on the inlet table 2. In such a case, the receiving mode signal is reset, in order to advance the sequence without waiting for the steel product. If there is any steel product on the inspection bed 1 or the inlet table 2, the receiving mode signal is set to make the sorting truck 7 receive the coming steel product in the next cycle of sequential operation. If the coming steel product has not arrived at the inlet table 2 yet, it will take some waiting time for the receipt of the steel product by the sorting truck 7. However, if the time difference is sufficiently short, it is preferred to conduct the receipt and delivery of the successive steel products concurrently, from the view point of saving time.

Then, a check is made from the stored information regarding the sorting truck 7, as to whether any bundle unit is under delivery. If there is any, the delivery mode is set to determine the position of the sorting truck 7 for the delivery of the next one of the steel products of the bundle unit under the delivery, and the signal representative of thus determined position of the sorting truck 7 is delivered to the sequence controller 23. If there is no bundling unit under the delivery, the computer determines the new bundle unit to be delivered. In the event that the new bundle unit to be delivered is determined, the mounting positions of the steel products of the thus determined bundle unit on the sorting trucks, as well as the mounting position on the truck coinciding with the vertically movable roller table 6, are investigated using the stored information. With this information, the computer determines such an order or sequence of the traversing of the sorting truck 7 as to minimize the distance of traversing of the truck 7 for the delivery of all steel products of the bundle unit. After the determination of this order, the delivery mode signal and the sorting bed No. signal are issued for the first one of the steel products of this bundle unit as stated before.

To the contrary, if the computer finds that the new bundle unit is not yet completed, the delivery mode is reset. In this case, if the receiving mode has already been reset, no actual operation is made. However, if the receiving mode only is set, the computer determines such a vacant sorting bed No., i.e. the mounting position, as to minimize the distance of the traverse movement of the sorting truck 7, and issues a signal representing this bed No. or mounting position.

Thus, in the cases where either the receiving or the delivery is made, the sequence start signal is issued finally.

On the other hand, the sequence controller 23 starts the automatic sequential operation in accordance with the sequence start signal from the computer 21. At first, the sequence controller 23 operates to bring the designated sorting bed No., i.e. the mounting position, into alignment with the vertically movable roller table 6. If the present position of the sorting truck meets the designated position, the process directly proceeds to the next step of sequence. However, if the present position does not meet the designated position, the sorting truck 7 is made to traverse to the designated position after the lowering of the vertically movable roller table 6. The sequence controller starts the movement of the sorting truck 7 either to the left or right in accordance with the result of judgement which is made in consideration of the present position of the sorting truck 7 and the designated position of the same. The operation is stopped as a signal is received from the limit switch corresponding to the designated position. The roller table 6 is then lifted upward.

The next step of the sequential operation is the receiving and delivery of the steel products. With the rollers of the vertically movable roller table 6 being rotated, the rollers of the inlet table 2 are driven if the receiving mode signal is being received. Also, if the delivery mode signal is being received simultaneously, the rollers of the outlet roller table 4 are driven concurrently. The rollers of the vertically movable table 6 are stopped, if no receiving mode signal is being delivered, as the delivery of the steel product is finished. However, if the receiving mode signal is being received, these rollers are stopped as the receipt of the steel product from the inlet table is finished. One cycle of the sequential operation is thus finished, as the vertically movable roller table 6 stops to operate. The sequence controller then delivers the signal representative of the stopping of the roller table 6 to the computer 21, for the inputting of the setting signals of the next cycle of sequence operation. This sequential operation is repeated cyclically to complete the sorting of the steel products automatically.

Although in FIG. 5, H-shaped steels are handled in the described embodiment, needless to say, the invention is applicable to all kinds of steel products requiring the sorting, of shaped steels of other cross-sectional shapes, such as rods, bars and so forth.

It is also to be noted that, while the described embodiment classifies the steel products into 3 classes each having 5 pieces of products using the sorting truck which can store 13 pieces of products at a time, the maximum number of pieces of steel products which can stay on the sorting truck may be varied suitably in accordance with the number of pieces of steel products included by a unit and the number of classes, i.e. the number of ordered lengths.

More specifically, the maximum number N of the pieces which can stay on the sorting truck can be given as follows, as a function of the number B of pieces included by a unit and the number P of the classes.

$$N=(B-1)P+1 \quad \ldots (1)$$

For instance, for sorting the steel products into 6 classes each including 5 pieces of products, the maximum number which stays on the sorting truck is calculated as follows:

$$(5-1)\times 6+1=25$$

Similarly, for sorting the steel products into 8 classes each including 5 pieces of products, the maximum number of stay is given as follows:

$$(5-1)\times 8+1=33$$

Assume here that steel products are bundled into 8 classes each having 5 pieces of products by means of the sorting apparatus having the maximum number of 25. In this case, as a natural result, a sorting failure or fraction of products is generated at a certain frequency. In such a case, it is allowed to make a smaller or odd bundle unit having 3 pieces of products, in order to accomodate the fraction. A simulation was made for 1000 pieces of steel products. The rate of generation of the smaller or odd bundling unit was as low as 0.9% in terms of the number of pieces of the products. Therefore, assuming that the generation of the odd number bundling is allowed up to the rate of 0.9%, it is possible to make the sorting into 8 classes each having 5 pieces by means of only one sorting truck having the maximum number of stay of 25 according to the invention, whereas the prior art requires 8 sorting beds or floors each can carry 5 pieces at a time.

Although in the described embodiment, the sorting apparatus includes a vertically movable roller table 6 and a sorting truck 7, it is possible to arrange such that the sorting truck 7 itself moved up and down while the table 6 is kept stationary. It is also possible to use a reversible chain conveyor in place of the sorting truck 7.

As has been described, according to the invention, it is possible to sort the steel products into a greater number of classes, using a compact and simple equipment. In consequence, it is possible to remarkably improve the yield rate. In addition, since the transfer of the products is made piece by piece, the undesirable overlapping or stacking of the products, as well as misalignment of the ends of the products, is completely eliminated to ensure a safe and efficient sorting thus contributing to the development of the field of industry concerned.

What is claimed is:

1. A method of sorting various kinds of steel products which are delivered by an inlet table in a random manner, said method comprising the steps of accumulating a random plurality of said steel products temporarily on a sorting apparatus having variable mounting position; selecting any desired one from said random plurality of steel products accumulated on the sorting apparatus and forwarding the selected steel product to an outlet table, while taking a subsequent random steel product from said inlet table; and repeating the above-mentioned steps, whereby said steel products of various classes transferred into said sorting apparatus in a random manner are successively sorted into desired classes and forwarded to an outlet table.

2. A method of sorting a random series of various types of products, comprising the steps of:

delivering a random series of various types of products along a first path;

accumulating a random plurality of various types of products on a sorting apparatus movable transversely to said first path;

selecting any desired one of a given type of product already accumulated on said sorting apparatus;

moving said sorting apparatus as necessary to position said any desired one for forwarding from said sorting apparatus along a second path and to position said sorting apparatus for receiving a subsequent product from said random series delivered along said first path;

moving said sorting apparatus as necessary to position another product of said given type for forwarding for along said second path; and repeating the foregoing steps, whereby the various types of products delivered in a random series along said first path are sorted by desired classes into groups forwarded along said second path.

3. A method according to claim 2, wherein said first and second paths are aligned.

4. A method according to claim 2, wherein the maximum number N of various types of products accumulated on said sorting apparatus equals $(B-1)P+1$, where B is the number of products of a given type to be forwarded in sequence along said second path and P is the number of types of products delivered along said first path.

5. An improved apparatus for sorting various types of products, comprising:

means for delivering a random series of various types of products along a first path;

truck means horizontally movable transversely to said first path for accumulating a random plurality of various types of products received from said means for delivering; and roller means vertically movable transversely to said truck means for removing a preselected one of said random plurality of various types of products from said truck means and forwarding said preselected one along a second path.

6. An apparatus according to claim 5, wherein said first and second paths are aligned.

7. An apparatus according to claim 5, wherein the maximum number N of various types of products accumulated on said means for accumulating equals $(B-1)P+1$, where B is the number of products of a given type to be forwarded in sequence along said second path and P is the number of types of products delivered along said first path.

8. An apparatus according to claim 5, wherein said truck means comprises an upper surface for supporting said plurality of various types of products and means for moving said truck means transversely to said first path; and said means for removing a preselected one comprises a plurality of rollers for supporting said preselected product and means for moving said plurality of rollers upward to lift said preselected product from said upper surface for forwarding along said second path.

9. An apparatus according to claim 8, wherein said rollers are positioned for receiving a subsequent product from said means for delivering, while forwarding a previous product along said second path.

* * * * *